US005332091A

United States Patent [19]

Gugler

[11] Patent Number: 5,332,091

[45] Date of Patent: Jul. 26, 1994

[54] BEVERAGE CONTAINER CARRIER

[76] Inventor: Donald Gugler, 10208 Swinton Ave., Sepulveda, Calif. 91343

[21] Appl. No.: 915,135

[22] Filed: Jul. 20, 1992

[51] Int. Cl.[5] ..... B65D 75/00

[52] U.S. Cl. ..... 206/167; 206/176

[58] Field of Search ..... 206/143, 144, 163, 165, 206/167, 169-178, 180-183, 185, 188-193, 198, 200, 427; 229/117.01, 117.05, 117.12, 117.14, 117.15

[56] References Cited

U.S. PATENT DOCUMENTS

| | | | |
|---|---|---|---|
| 1,977,102 | 10/1934 | Wheeler | 206/167 |
| 2,006,454 | 7/1935 | Hatch | 206/167 |
| 2,007,438 | 7/1935 | Agar | 206/167 |
| 3,018,919 | 1/1962 | Pelt | 206/144 |
| 4,286,709 | 9/1981 | Manizza | 206/170 |

FOREIGN PATENT DOCUMENTS

| | | | |
|---|---|---|---|
| 0550164 | 10/1956 | Belgium | 206/174 |
| 0453844 | 1/1949 | Canada | 206/193 |
| 1502881 | 10/1967 | France | 206/174 |
| 0829685 | 3/1960 | United Kingdom | 206/176 |

*Primary Examiner*—Jimmy G. Foster
*Attorney, Agent, or Firm*—Allan M. Shapiro

[57] ABSTRACT

The beverage container carrier has a central panel formed of double thickness cardboard attached together for the height of the beverage container. Above the beverage container, the separate walls of the central panel fold outward to cover the tops of the beverage container. At the bottom of the central panel, the walls fold out to form the bottom and outside of pockets which receive the beverage containers. Two identical blanks can form the beverage container carrier.

14 Claims, 2 Drawing Sheets

BEVERAGE CONTAINER CARRIER

FIELD OF THE INVENTION

This invention is directed to a beverage container carrier of cardboard construction which can be folded flat when not in use and erected when needed. When beverage containers are installed in the carrier, the handles at the top of the central panel can be folded down over the beverage containers or raised to act as a handle.

BACKGROUND OF THE INVENTION

Many beverages are sold in containers of a fairly standard size. These drinks include sodas, colas, fruit drink and beer. Such beverage containers are usually sold only singly when immediate consumption is contemplated. Quite often, the beverage containers are sold in six packs. When assembled into six-pack configuration at the bottling plant, machine installation of a cutout flexible polymer sheet over the rims of the beverage containers is used. Assembly is not as satisfactory when attempted by hand. The packaging of beverage containers into six packs by hand is more readily arranged when a beverage container carrier is formed so that, when not in use, it can be folded flat. When filled with beverage containers, it should have a flat top so that a plurality of such beverage container carriers can be stacked and, when sold to the consumer, the carrier should be provided with a handle for convenient carrying. Thus, there is need for an improved beverage container carrier.

SUMMARY OF THE INVENTION

In order to aid in the understanding of this invention, it can be stated in essentially summary form that it is directed to a beverage container carrier wherein two identical blanks are secured together to form pockets and form a central panel which lies between the beverage containers therein. The central panel is not joined at the top and forms a cover for stacking and forms a handle for carrying.

It is thus an object and advantage of this invention to provide a beverage container carrier having a central panel which extends above the beverage containers to alternately form a cover and a handle.

It is another object and advantage of this invention to provide a beverage container carrier which is formed of two identical blanks which, when secured together, form six folding pockets, three on each side of a central panel, with the central panel extending above the beverage containers in the pockets to define an alternate cover and handle.

It is a further object and advantage of this invention to provide a beverage container carrier which can be readily unfolded into useful form and which can be manually filled with beverage containers and, thereupon, stacked.

It is a further object and advantage of this invention to provide a beverage container carrier which is particularly useful in stores for packaging together six packs and the like from larger and/or smaller beverage container groups.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

DESCRIPTION OF THE PREFERRED EMBODIMENTS

Figure 1:
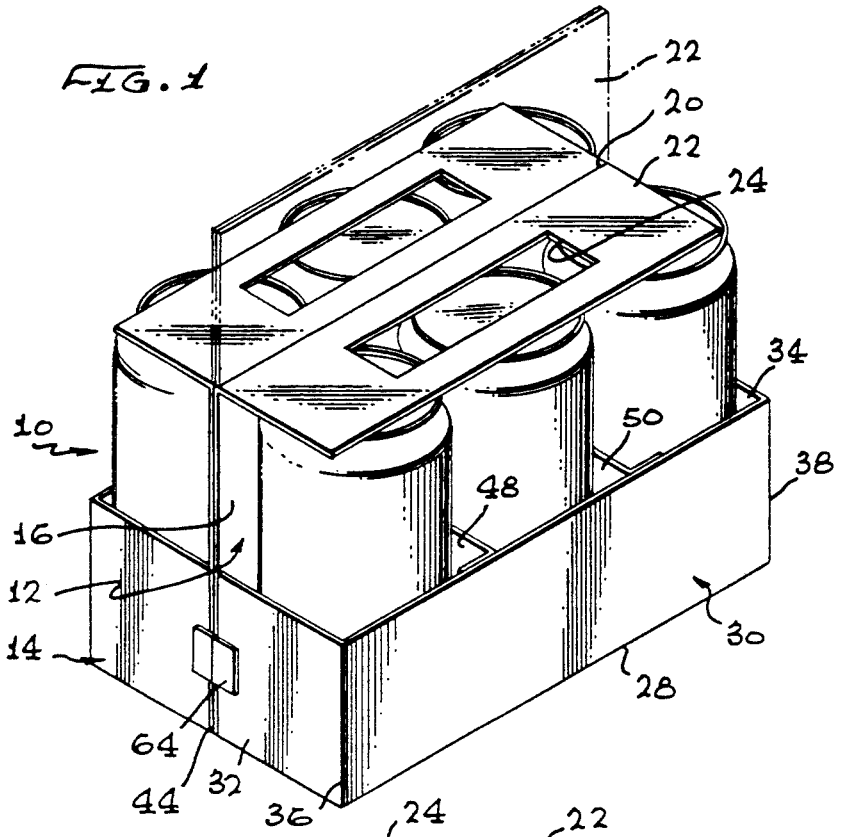
FIG. 1 is an isometric view of the beverage container carrier of this invention, showing the upper panel as a top cover in full lines and as a handle in dashed lines.
Figure 2:
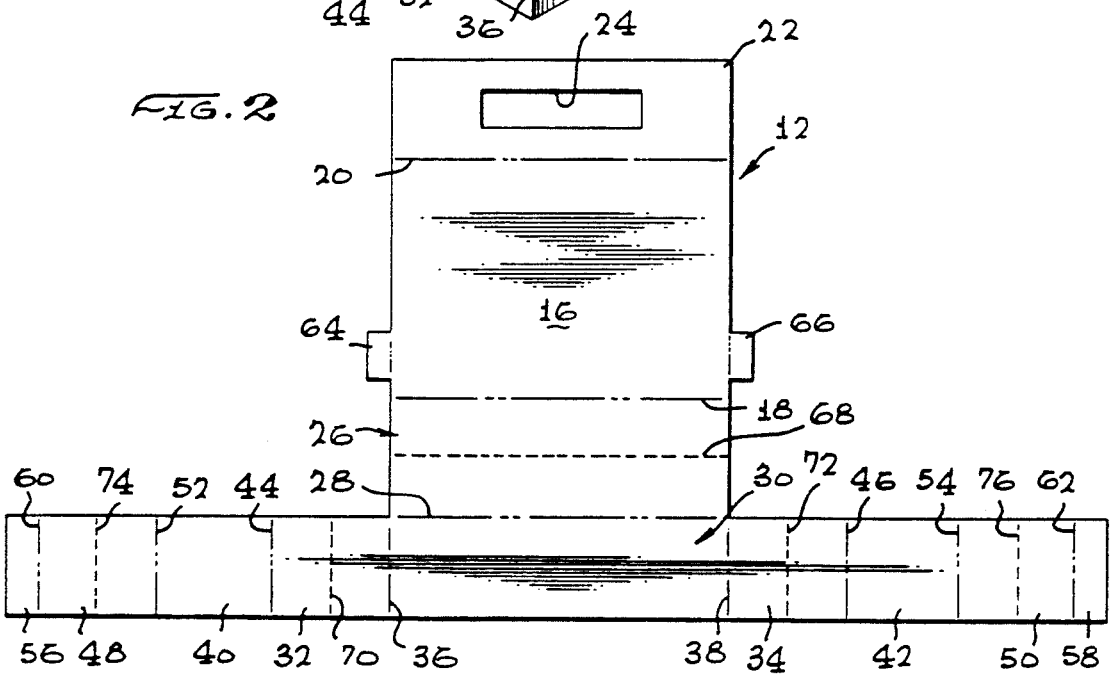
FIG. 2 is plan view of one of the two blanks used to form the beverage container carrier of FIG. 1.
Figure 3:
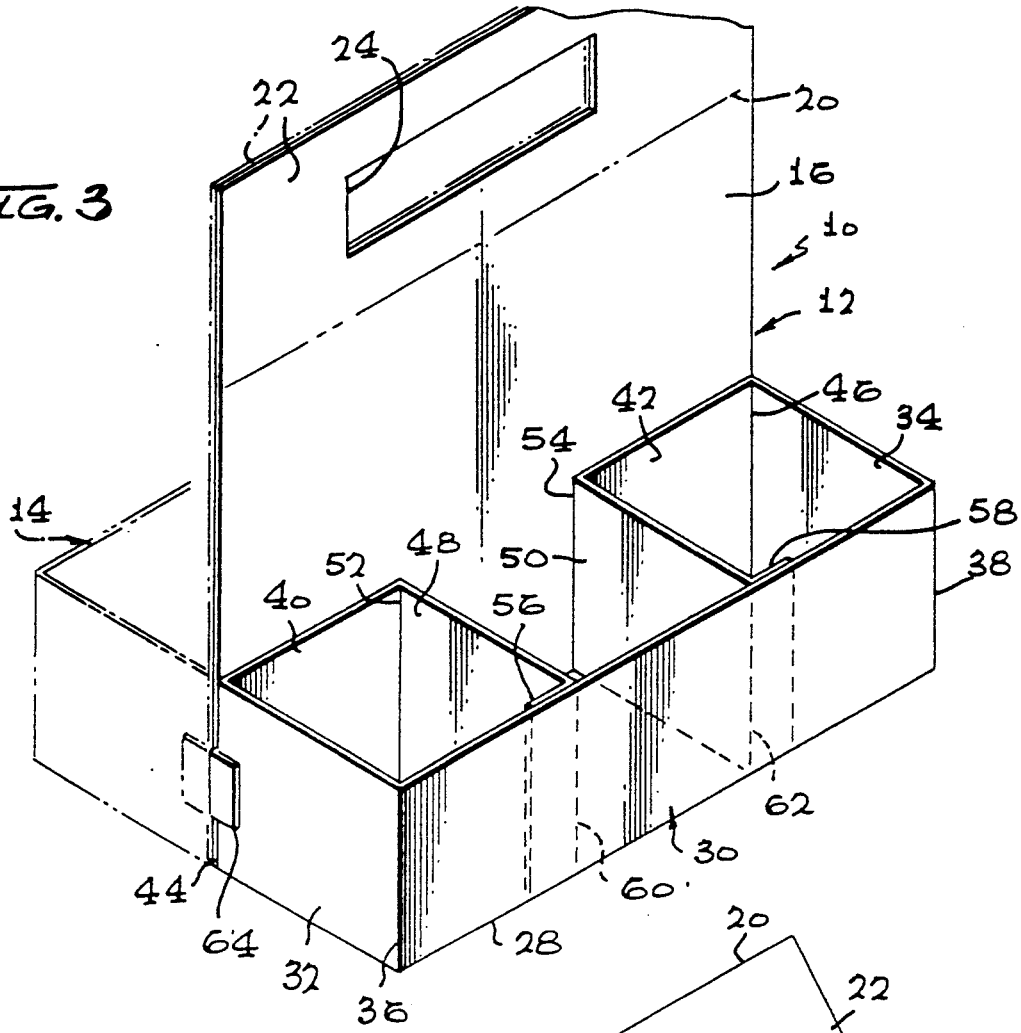
FIG. 3 is similar to FIG. 1, showing the near blank folded into carrier configuration and the rear blank in dashed lines.
Figure 4:
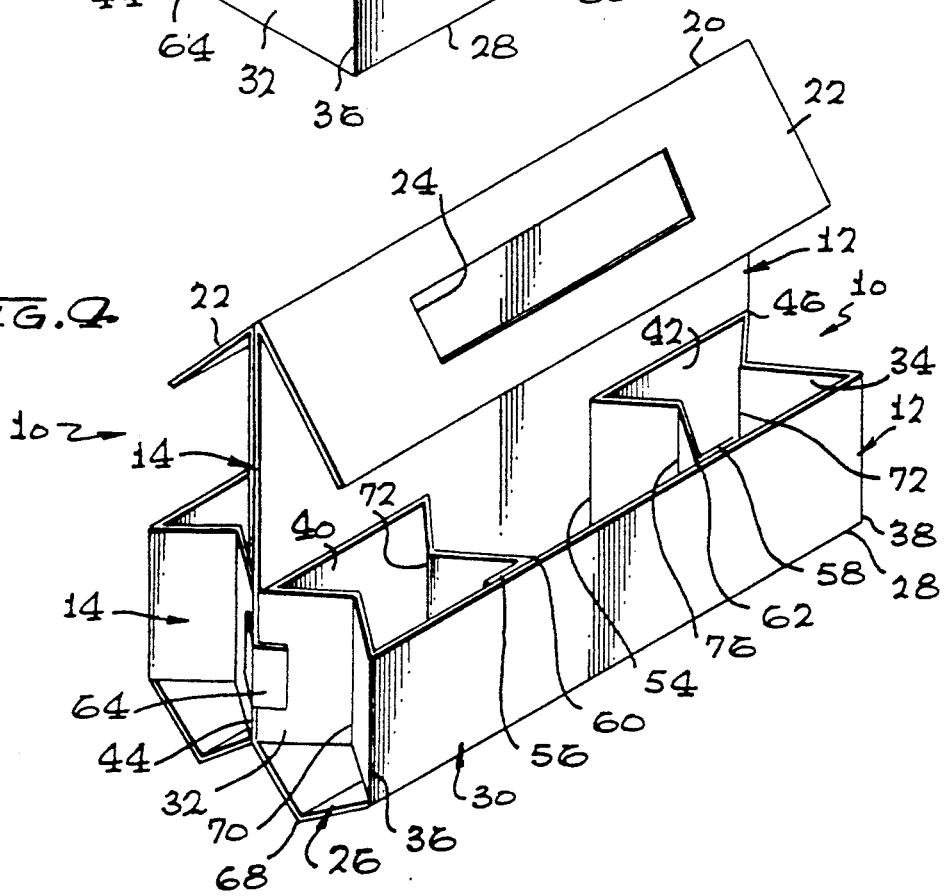
FIG. 4 is an isometric view showing the two blanks secured together and partially folded into storage position.

FIGS. 1 and 4 show a preferred embodiment of the beverage container carrier of this invention wherein it is generally indicated at 10. The beverage container carrier 10 is formed of two identical blanks. The front blank 12 is seen in FIGS. 1, 2, 3 and 4, while the identical rear blank 14 is shown in full lines in FIGS. 1 and 4 and in dashed lines in FIG. 3. In FIGS. 1, 3 and 4, the blanks are in the folded condition, while in FIG. 2, blank 12 is shown in the flat condition. Referring to blank 12 in FIG. 2, the blank has a central panel 16 which, in the preferred structure for carrying six beverage containers, is equal in height from its bottom fold line 18 to its top fold line 20 to the height of the beverage containers to be carried in the carrier. As seen in FIG. 1, the central panel 16 is flat and equal in height to the height of beverage containers and equal in width to the width of three of the beverage containers.

Handle panel 22 is joined to the top of the central panel 16 at the top fold line 20. The height of the handle panel 22, in the direction parallel to the central panel 16, as seen in FIG. 3, is substantially equal to the diameter of one of the beverage containers so that, when folded down, the handle panel 22 substantially overlies the three beverage containers on that side of the central panel 16. Handle panel 16 has a handle cutout 24 therein so that, when the handle panel is raised, three or four fingers of the hand can be inserted through the handle cutout to lift and carry the beverage container. Lifting forces are transferred directly from the handle panel to the central panel because they are contiguous and unitary, separated only by the fold line 20.

Below the central panel 16 is bottom panel 26. The bottom panel is substantially the same size as the handle panel 22. It is necessary for the bottom panel to have a length equal to or slightly greater than the diameters of the three beverage containers to be carried on that side and have a width equal to or slightly greater than the diameter of one of the beverage containers because the three beverage containers rest on this bottom panel. Joined to the bottom panel 26 at fold line 28 is outer wall panel 30. The outer wall panel 30 serves as a wall to retain the beverage containers, as seen in FIG. 1. The outer wall panel 30 is the central one of a series of wall panels which are longitudinally joined together at fold lines, as seen in FIG. 2. Left and right end wall panels 32 and 34 are respectively attached to the outer wall panel 30 at fold lines 36 and 38. The left and right end wall panels are the same height as the outer wall panel and have a length equal to the width of the bottom panel 26.

Outward from the end wall panels are left and right attachment panels 40 and 42, which are respectively attached to the left and right end wall panels at fold lines 44 and 46. The attachment panels are the same length as the end wall panels. Respectively attached to the attachment panels are left and right interior wall panels 48 and 50. The left and right interior wall panels 48 and 50 are respectively attached to the left and right attachment panels at fold lines 52 and 54. Left and right attachment tabs 56 and 58 are respectively attached to the left and right interior wall panels 48 and 50 at fold lines 60 and 62. In addition, the central panel 16 carries left and right central panel tabs 64 and 66 on the left and right edges thereof, see FIG. 2. These central panel tabs are preferably on the edges of the central panel 16 at a height above fold line 18 at a distance from about half to equal to the height of the left and right end wall panels 32 and 34. The top edge of the central panel tab should be no greater distance from the fold line 18 than the height of the end wall panels. The structure thus far described is a single blank, including the various walls and panels.

FIG. 3 shows the blank 12 appropriately folded and adhesively attached. The left and right attachment panels 40 and 42 are adhesively attached to the central panel 16, and the attachment tabs 56 and 58 are appropriately adhesively attached to the inside of outer wall panel 30. The left and right attachment tabs 56 and 58 are brought forward, as seen for the tab 64 in FIGS. 1, 3 and 4, and are adhesively attached to the left and right end wall panels 32 and 34. This creates three equal-sized square pockets, as seen in FIG. 3. These pockets are appropriate to receive beverage containers, as seen in FIG. 1. The folded and adhesively attached blank 12, as seen in FIG. 3, is adhesively attached to the folded and adhesively attached blank 14 in back-to--back relationship so that the central panels 16 of the two blanks adjoin and are attached. This structure is seen in FIGS. 1 and 4 and in dashed lines in FIG. 3. This is the complete beverage container carrier 10.

The height of the central panel is such that the two handle panels 22 can be folded down over the tops of the beverage containers to aid in stacking of a plurality of filled beverage container carriers 10. This configuration is seen in FIG. 1. When it is desired that the beverage container carrier 10 be carried in the hand, the two handle panels 22 are raised so that they lie together, as seen in dashed lines in FIG. 1. The customer can now conveniently carry the beverage container carrier 10. The central panel 16 being contiguous with the bottom panel 26 and the outer wall panel 30 provides a strong carrier. The outer wall panel is securely held in place by the integral end wall panels and interior wall panels which tie the outer wall panel 30 to the central panel 16. A strong and versatile beverage container carrier is thus formed. The height of the central panel can be established by the height of the beverage container which is to be carried. It is also useful for bottled beverages, with appropriate dimensions. In the case of bottled beverages, the handle panels aid in stabilizing the stacking of a plurality of such beverage container carriers.

It is desirable that the beverage container carrier 10 be foldable so that it does not occupy as much volume when there are no beverage containers therein. To permit the structure to be folded, crease lines are provided. Crease line 68 is provided through the center of bottom panel 26. Crease lines 70 and 72 are respectively provided across the centers of left and right end wall panels 32 and 34. Similarly, crease lines 74 and 76 are provided across the centers of left and right interior wall panels 48 and 50, respectively. These crease lines respectively permit the folding of the respective panels, as seen in FIG. 4. The bottom panel 26 folds down, the end wall panels fold in, and the interior wall panels fold out so that the outer wall panel 30 moves directly toward central panel 16 to lie directly there-adjacent when in the flat position. FIG. 4 shows the partly folded condition, and it is seen that the outer wall panels can move directly toward the central panel and lie close thereto, separated only by the creased wall panels. The folded carrier 10 is no wider than the erect carrier 10 and is only a half bottom panel taller than the erect carrier 10. In this way, the beverage container carrier 10 occupies minimum space prior to use. When it is desired that beverage containers be placed in the carrier 10, it is folded out to the deployed position shown in FIG. 1, and the beverage containers are inserted therein.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A beverage container carrier comprising:

a central panel comprising a sheet of material having first and second sides;

panels formed of the same sheet of material as said central panel for defining a plurality of pockets on each said first and second sides of said central panel, said pockets being sized so that each said pocket can receive a single beverage container, said central panel extending upward between said pockets and terminating substantially at the top of beverage containers in said pockets;

said panels including a first bottom panel formed of said sheet of material and joining said central panel at a fold line and underlying said pockets on said first side to support beverage containers in said pockets on said first side, said panels including first and second outer wall panels formed of said sheet of material and joining said first and second bottom panels at fold lines, said first and second outer wall panels respectively forming the sides of said pockets opposite said central panel so as to close the outer side of each said pocket;

said panels including a series of panels formed of said sheet of material and joining said outer wall panels at fold lines to define said pockets and attach said outer wall panel to said central panel;

said series of panels attached to said outer wall panels including an end wall panel on each end of each said series of panels, an attachment panel attached to said outer wall panel and an interior wall panel attached to each said attachment panel, said wall panels and said attachment panels being sized to define three pockets of substantially equal size, said bottom panel and said wall panels having creases therein to permit folding of said beverage container carrier so that in the folded position said outer wall panel lies adjacent said central panel and said pockets are substantially closed; and first and second handle panels attached at fold lines to the top of said central panel substantially at the top of the beverage containers in said pockets, said handle panels having first and second positions, said first position being an upright position wherein said handle panels lie substantially together in the plane of said central panel so that said handle panels can be grasped to raise said carrier, and said second position of said handle panels being a lowered position wherein said handle panels are folded down on said fold lines to substantially overlie said pockets and extend over the top of the beverage containers in said pockets.

2. The beverage container carrier of claim 1 wherein said carrier is formed of first and second substantially identical blanks which are joined together at said central panel and said handle panels are respectively contiguous to said first and second central panels.

3. A beverage container carrier comprising:

first and second substantially identical blanks each made of a sheet of material, each of said blanks having a central panel portion, said central panel portions being secured together to form a central panel of said beverage container carrier, said central panel portions respectively having first and second handle panels integrally formed therewith for carrying said beverage container carrier, a plurality of pockets forming a row on each side of said central panel, an end pocket on each end of said row and at least one intermediate pocket therebetween, said pockets being substantially square and of sufficient size so that each pocket receives a single beverage container and said central panel being sufficiently tall so that it substantially reaches the top of the beverage containers in said pockets, each said blank having a bottom panel made of the same sheet of material as said central panel and joined at fold lines, said bottom panels forming the bottoms of said pockets on opposite sides of said central panel, each of said blanks having an outer wall panel thereon with said outer wall panel made of the same sheet of material as said bottom panel, said outer wall panels being positioned so that they form the outer wall of said pockets, end wall panels made of the same sheet of material as said outer wall panels to define the end walls of said end pockets, attachment panels made of the same sheet of material as said end wall panels for attachment to said central panel to secure said end wall panels, interior wall panels made of the same sheet of material as said attachment panels, said interior wall panels being attached to said outer wall panels to define said at least one intermediate pocket on each side of said central panel, said handle panels being sized so that when in a first position they substantially lie over the top of beverage containers in said pockets, each of said handle panels having a cutout therein, said handle panels being foldable together into a second position, said handle panels lying together in the second position so that said handle panels can be manually grasped at said cutouts to conveniently carry said beverage container carrier.

4. A beverage container carrier comprising:

first and second blanks, each of said blanks being formed of a sheet of material and having a central panel, said central panels each having a handle integrally formed therewith for carrying said beverage container carrier, three pockets on each side of said central panels, said pockets being of sufficient size so that each pocket receives a single beverage container and said central panels being sufficiently tall so that they substantially reach the top of the beverage containers in said pockets, each said blank having a bottom panel made of the same sheet of material as said central panel, said bottom panels forming the bottoms of said pockets on opposite sides of said central panel, each of said blanks having an outer wall panel thereon with said outer wall panels made of the same sheet of material as said bottom panels, said outer wall panels being positioned so that they form the outer wall of said pockets, end wall panels made of the same sheet of material as said outer wall panels to define the end walls of said pockets, attachment panels made of the same sheet of material as said end wall panels for attachment to said central panel to secure said end wall panels, interior wall panels made of the same sheet of material as said attachment panels, said interior wall panels being attached to said outer wall panels to define said three pockets on each side of said central panel, each of said handles being made of the same sheet of material as the central portion of its corresponding blank, said handles being sized so that when in a first position they substantially lie over the top of beverage containers in said pockets, each of said handles having a fold line and having a cutout therein so that said handles are foldable together into a second position, said handles lying together in the second position so that said handles can be manually grasped at said cutouts to carry said beverage container carrier.

5. A beverage container carrier comprising:

first and second blanks, each of said blanks having a central panel portion, said central panel portions each having a handle panel contiguously formed therewith for carrying said beverage container carrier, said central panel portions being secured together to form a central panel, three pockets on each side of said central panel, said pockets being substantially square and of sufficient size so that each pocket receives a single beverage container and said central panel being sufficiently tall so that it substantially reaches the top of the beverage containers in said pockets, each said blank having a bottom panel joined to its respective central panel portion at a fold line, said bottom panels forming the bottoms of said pockets on opposite sides of said central panel, each of said blanks having an outer wall panel thereon with said outer wall panel joined to said bottom panel at a fold line, said outer wall panels being positioned so that they form the outer wall of said pockets, end wall panels joined to said outer wall panels at a fold line to define the end walls of said pockets, attachment panels joined to on said end wall panels at a fold line for attachment to said central panel to secure said end wall panels, interior wall panels joined to said attachment panels at a fold line, said interior wall panels being attached to said outer wall panels to define said three pockets on each side of said central panel, said handle panels being joined to its respective central panel portion at fold lines, said handle panels being sized so that when in a first position they substantially lie over the top of beverage containers in said pockets, each of said handle panels having a cutout therein, said handle panels being foldable together on said fold lines into a second position, said handle panels lying together in the second position so that said handle panels can be manually grasped at said cutouts to carry said beverage container carrier, said end wall panels and said interior wall panels being creased to permit folding of said carrier to close said pockets to reduce the size of said carrier when no beverage containers are carried therein.

6. A beverage container carrier comprising:

first and second substantially identical blanks each made of a sheet of material, each of said blanks having a central panel portion having a height substantially equal to the beverage container to be carried in said carrier and having a length substantially equal to a multiple of the thickness dimension of a beverage container to be carried in said carrier, said central panel portions being secured together to form a central panel and being substantially the only portion of said beverage container wherein one of said blanks is secured to the other of said blanks;

a handle panel attached to each of said blanks above said central panel portions at a fold line, each of said handle panels having a handle cutout therein, each of said handle panels having a first position wherein said handle panels lie together and can be grasped for manual carrying of said beverage container carrier, each of said handle panels being foldable on said fold line to a second position where said handle panels lie apart from each other so that said handle panels overlie beverage containers on opposite sides of said central panel so that when said handle panels are in their second position, they aid in stacking of a plurality of said beverage container carriers; and a plurality of beverage container pockets on each side of said central panel, said pockets being formed of panels successively attached to the central panel at fold lines and made from said sheet of material.

7. A beverage container carrier comprising:

first and second substantially identical blanks each made of a sheet of material, each of said blanks having a central panel portion having a height substantially equal to the beverage containers to be carried in said carrier and having a length substantially equal to a multiple of the thickness dimension of a beverage container to be carried in said carrier, said central panel portions being secured together to form a central panel and being substantially the only portion of said beverage container wherein one of said blanks is secured to the other of said blanks;

a handle panel attached to each of said blanks above said central portions at a fold line, each of said handle panels having a handle cutout therein, each of said handle panels having a first position wherein said handle panels lie together and can be grasped for manual carrying of said beverage container carrier, each of said handle panels being foldable on said fold line to a second position where said handle panels lie apart from each other so that said handle panels overlie beverage containers on opposite sides of said central panel so that when said handle panels are in their second position, they aid in stacking of a plurality of said beverage container carriers; and a plurality of beverage container pockets on each side of said central panel, said pockets being formed of panels successively attached to the central panel at fold lines, said pockets having crease lines therein so that, when no beverage container is positioned in said pockets, said pockets can be folded closed by folding along said crease lines.

8. The beverage container carrier of claim 7 wherein said pockets are formed of a bottom panel contiguous to said central panel and an outer wall panel contiguous to said bottom panel, together with means for attaching said outer wall panel to said central panel.

9. A beverage container carrier comprising:

first and second substantially identical blanks, each of said blanks being made of a sheet of material, each of said blanks having a central panel portion having a height substantially equal to the beverage containers to be carried in said carrier and having a length substantially equal to a multiple of the thickness dimension of a beverage container to be carried in said carrier, said central panel portions being secured together to form a central panel and being substantially the only part of said beverage container wherein one of said blanks is secured to the other of said blanks;

a handle panel attached to each of said blanks above said central panel portions at a fold line, each of said handle panels having a handle cutout therein, each of said handle panels having a first position wherein said handle panels lie together and can be grasped for manual carrying of said beverage container carrier, each of said handle panels being foldable on said fold line to a second position where said handle panels lie apart from each other so that said handle panels overlie beverage containers on opposite sides of said central panel so that when said handle panels are in their second position, they aid in stacking of a plurality of beverage container carriers; and a plurality of beverage container pockets on each side of said central panel, said pockets being formed of panels sequentially joined to the adjacent central panel blank, said pockets having crease lines therein so that when no beverage container is positioned in said pockets, said pockets can be folded closed by folding along said crease lines, said pockets being formed of a bottom panel joined to said central panel and an outer wall panel joined to said bottom panel, a central panel attachment tab on each end of said central panel, said central panel attachment tabs being respectively adhesively attached to said outer wall panels to secure said outer wall panels with respect to said central panel.

10. The beverage container carrier of claim 9 wherein said means for attaching said outer wall panel to said central panel comprise end wall panels and interior wall panels attached between said central panel and said outer wall panel for defining said pockets and for securing said outer wall panel with respect to said central panel.

11.. The beverage container carrier of claim 10 wherein said end wall panels are contiguously formed with said outer wall panel.

12. A beverage container carrier comprising:

first and second substantially identical blanks, each of said blanks being formed of a sheet of material, each of said blanks having a central panel portion having a height substantially equal to the beverage containers to be carried in said carrier and having a length substantially equal to a multiple of the thickness dimension of a beverage container to be carried in said carrier, said central panel portions being secured together to form a central panel and being substantially the only portion of said beverage container wherein one of said blanks is secured to the other of said blanks;

a handle panel attached to each of said blanks above said central panel portions at a fold line, each of said handle panels having a handle cutout therein, each of said handle panels having a first position wherein said handle panels lie together and can be grasped for manual carrying of said beverage container carrier, each of said handle panels being foldable on said fold line to a second position where said handle panels line apart from each other so that said handle panels overlie beverage containers on opposite sides of said central panel so that when said handle panels are in their second position, they aid in stacking of a plurality of said beverage container carriers; and a plurality of beverage container pockets on each side of said central panel, said pockets being formed of panels sequentially joined to the adjacent central panel blank, said pockets having crease lines therein so that, when no beverage container is positioned in said pockets, said pockets can be folded closed by folding along said crease lines, said pockets being formed of a bottom panel joined to said central panel and an outer wall panel joined to said bottom panel, together with means for attaching said outer panel to said central panel, said means for attaching said outer wall panel to said central panel comprising end wall panels and interior wall panels attached between said central panel and said outer wall panel for defining said pockets and for securing said outer wall panel with respect to said central panel, said end wall panels being joined to said outer wall panel, and an attachment panel formed with each of said end panels, said attachment panels being secured to said central panel for securing said outer wall panel with respect to said central panel.

13. The beverage container carrier of claim 12 wherein there is an interior wall panel contiguously attached to each said attachment panel for defining said pocket.

14. The beverage container carrier of claim 13 further including a central panel attachment tab on each end of said central panel, said central panel attachment tabs being respectively adhesively attached to said end wall panels to secure said end wall panels with respect to said central panel.

* * * * *